United States Patent [19]

Wilcox et al.

[11] 4,260,975

[45] Apr. 7, 1981

[54] TRANSFORMER WITH TERMINAL BOARD SUPPORT AND CLAMPING-MOUNTING STRUCTURE

[75] Inventors: Albert F. Wilcox, Yoder; Don C. Wood, Fort Wayne; Richard H. Wagner, Huntertown, all of Ind.

[73] Assignee: General Electric Company, Salem, Va.

[21] Appl. No.: 42,764

[22] Filed: May 29, 1979

[51] Int. Cl.[3] ..... H01F 15/10; H01F 27/26

[52] U.S. Cl. ..... 336/65; 336/192; 336/210

[58] Field of Search ..... 336/210, 178, 65, 67, 336/68, 192, 211

[56] References Cited

U.S. PATENT DOCUMENTS

| | | | |
|---|---|---|---|
| 1,974,588 | 9/1934 | Snell | 336/210 X |
| 2,408,211 | 9/1946 | Hodnette | 336/210 X |
| 2,450,973 | 10/1948 | Lingel | 336/65 X |
| 2,529,653 | 11/1950 | Epstein | 336/210 X |
| 2,547,675 | 4/1951 | Treanor | 336/210 |
| 2,595,820 | 5/1952 | Somerville | 336/210 X |
| 2,699,531 | 1/1955 | Massar | 336/67 X |
| 2,906,977 | 9/1959 | Rowley et al. | 336/210 X |
| 3,028,567 | 4/1962 | Mittermaier | 336/65 |
| 3,662,308 | 5/1972 | Muschong | 336/210 |

FOREIGN PATENT DOCUMENTS

| | | | |
|---|---|---|---|
| 2650929 | 11/1978 | Fed. Rep. of Germany | 336/178 |
| 1050309 | 12/1966 | United Kingdom | 336/210 |

*Primary Examiner*—Thomas J. Kozma
*Attorney, Agent, or Firm*—Arthur E. Bahr; James H. Beusse

[57] ABSTRACT

A transformer having a core and coil assembly which includes a pair of cores disposed side by side, the core members being of the squared "O" type formed of a plurality of nested, generally rectangular laminations. A space is provided between a pair of adjacent laminations in corresponding locations in each core, and a coil surrounds the adjacent sides of the respective cores through the central openings of the cores. Also included is a terminal board support having a pair of tabs to be inserted in the spaces between the adjacent laminations, the tabs being provided with holes having extruded edges for frictional engagement with the core laminations. The core and coil assembly is placed upon a flat base member and a U-shaped band is placed so as generally to encompass the top and two sides of the core and coil structure to make contact with a part of up-turned flanges of the base member. The assembly is compressed together and the U-shaped band is fixedly secured to the up-turned flanges of the base member, as by welding. This tensional engagement of the band with the base member serves to retain the terminal board support tabs in place while holding the core and coil assembly to the base member, thereby to provide a unitary structure replete with means for mounting the transformer assembly.

5 Claims, 4 Drawing Figures

TRANSFORMER WITH TERMINAL BOARD SUPPORT AND CLAMPING-MOUNTING STRUCTURE

BACKGROUND OF THE INVENTION

1. Field of the Invention

The present invention relates to an improved transformer having a clamping-mounting structure and a terminal board support, and more particularly, to a transformer having a core and coil assembly including a pair of cores generally of the squared "O" type and a unitary clamping-mounting structure for securing a terminal board support in place in the core and coil structure while providing means for clamping together the core and coil assembly and for mounting the transformer where desired.

2. Description of the Prior Art

Prior art transformers comprising cores made up of a plurality of flat laminations, whether they include E's, C's, I's, or the like, have seen many and varied types of transformer clamping and mounting arrangements. The advent of the "O" core transformer, that is, one having a core made up of a plurality of nested laminations, each lamination being formed from a flat, strap-like piece, has presented the designer with a challenge. As with any transformer, the "O" core transformer must be provided with means for holding, confining, and mounting the core and coil assembly; the assembly, however, is provided with no holes or appendages which may be used for these purposes.

It is desirable, therefore, to provide a clamping and mounting structure for a transformer assembly having a pair of cores made up of a plurality of nested laminations. It is further desirable to provide a transformer assembly having means integral therewith for supporting a terminal board.

It is therefore, an object of the present invention to provide a transformer assembly including integral clamping-mounting means and further including means for securing to the transformer assembly a terminal board.

SUMMARY OF THE INVENTION

In accordance with the present invention, there is provided an electrical transformer having clamping and mounting means and a terminal board support integral with the assembly. Included is a core and coil assembly having a pair of magnetic cores disposed side by side. The cores, respectively, are of the type being formed of a plurality of nested, generally rectangular laminations and having a central opening. A space is provided between a pair of adjacent laminations in each core, in corresponding locations in the respective cores. An electrical coil surrounds adjacent sides of the respective cores through the central openings thereof. A terminal board support includes portions for insertion in frictional engagement in the spaces provided between adjacent laminations in each core. A base member is provided for receiving thereon the core and coil assembly and for mounting the transformer, the base member being provided with a pair of up-turned flanges at opposite ends thereof. A generally U-shaped band surrounds the top and two sides of the core and coil assembly, the band being fixedly secured to the up-turned flanges of the base member in tensional engagement, thereby to secure the terminal board support in place and further to prevent movement of the core and coil assembly relative to the base member.

DESCRIPTION OF THE PREFERRED EMBODIMENT

Figure 1:
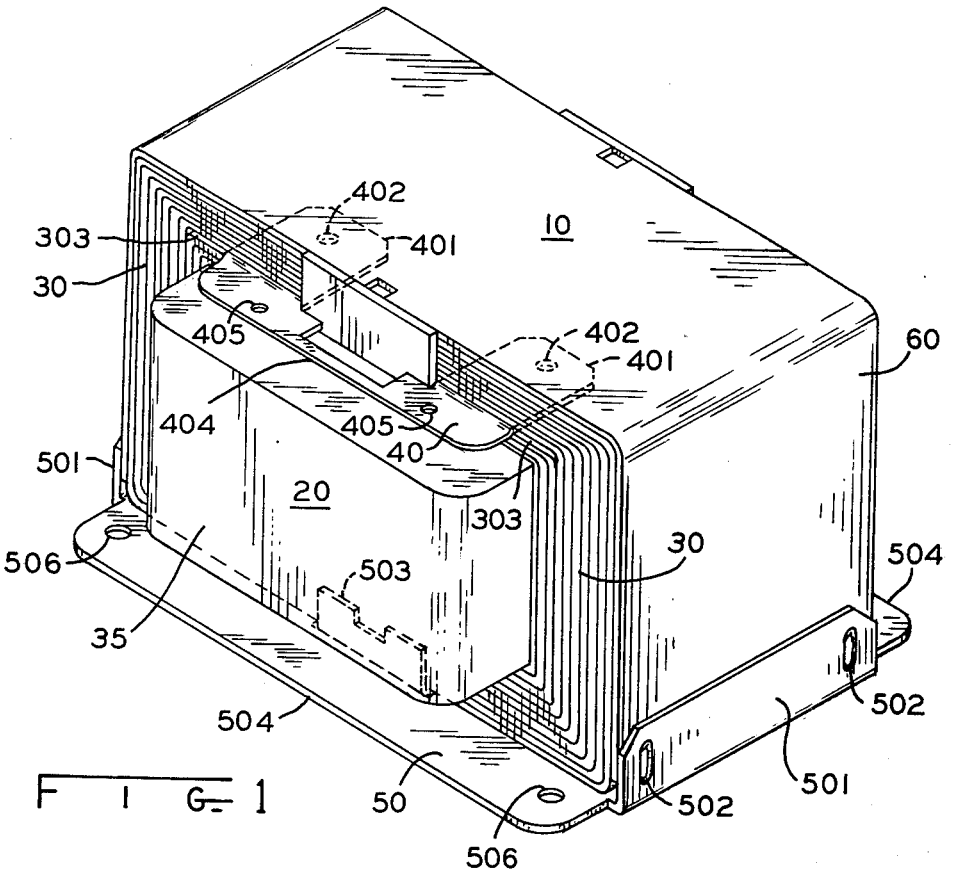
FIG. 1 is a perspective view of the preferred embodiment of the transformer assembly of the present invention.
Figure 3:
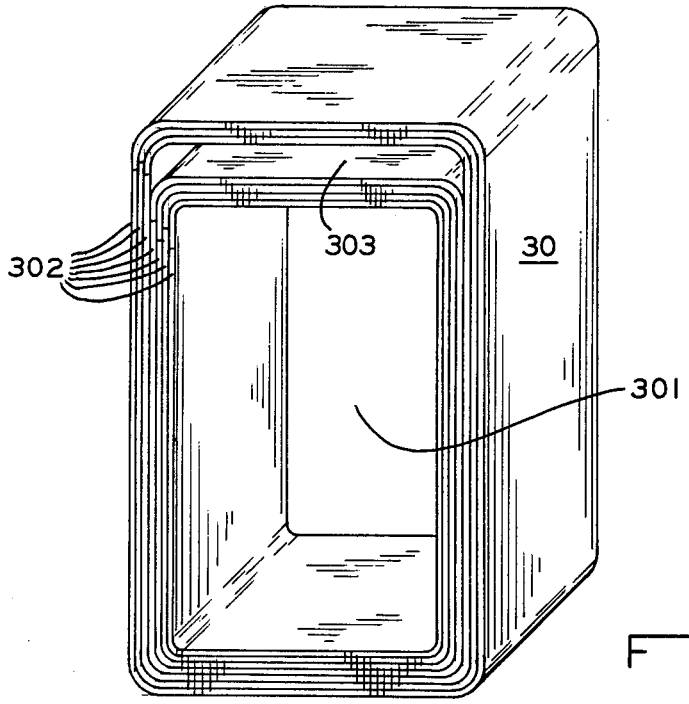
FIG. 3 is a perspective view showing one core of the transformer assembly of FIG. 1.

In accordance with the present invention and referring now to FIG. 1, there is shown the preferred embodiment of electrical transformer 10 of the present invention. A core and coil assembly 20 includes a pair of magnetic cores 30 disposed side by side. Cores 30, several laminations of one being seen in more detail in FIG. 3, are of the type formed of a plurality of nested, generally rectangular laminations 302 and having central opening 301. A space 303 is provided between a pair of adjacent laminations, these spaces being in corresponding locations in the respective cores 30 (FIG. 1). An electrical coil 35 surrounds the adjacent sides of the respective cores 30 through the central openings 301 thereof and essentially fills the central openings.

A terminal board support 40 is provided formed of sheet metal. The details of this terminal board support 40 may be seen by referring to FIG. 4. Support 40 is provided with portions, a pair of tabs 401, for insertion in the spaces 303 between the laminations of cores 30, as shown in FIG. 1. Tabs 401 are each provided with a hole 402, the lower edges of each of which are extruded so as to provide frictional engagement with one of the laminations 302 of each of the cores 30.

A base member 50 is provided for receiving thereon the core and coil assembly 20. This base member 50 includes a pair of up-turned flanges 501 at opposite ends thereof. Details of base member 50 may be seen in FIG. 2 and will be discussed hereinafter.

A generally U-shaped band 60 surrounds the top and two sides of the core and coil assembly 20. In assembly, band 60 is placed over the core and coil assembly; the top of the band 60 and the base 50 are then compressed together. The band 60 is then fixedly secured to the up-turned flanges 501 of the base member 50, as by welding at the elongated slots 502 shown thereon. Once the compressive force is removed, the band 60 is in tensional engagement with the up-turned flanges 501, this assisting in securing the terminal board support 40 in place between adjacent laminations and further, preventing movement of the core and coil assembly 20 relative to the base member 50.

Figure 2:
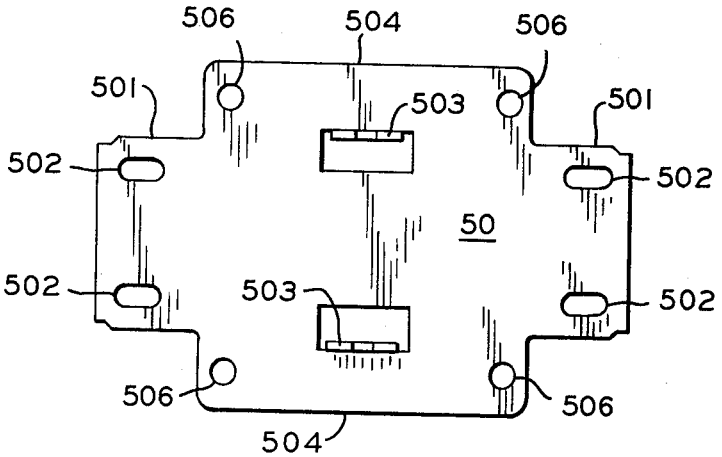
FIG. 2 is a plan view of the base member of the transformer assembly of FIG. 1.

Under certain circumstances, it may still be possible for the core and coil assembly to be vibrated loose and free of the band and base. In order to prevent such an eventuality, the base 50, as shown in FIGS. 1 and 2, is provided with a pair of up-turned flanges 503 which serve to hold the core and coil assembly 20 in place and against lateral movement relative to the band and base assembly. In actual practice, base member 50 is formed as shown in FIG. 2, with the end flanges 501 left unturned.

With such a transformer as shown in FIG. 1, laminations may be added or subtracted to meet the specific requirements of a particular magnetic circuit. Since the addition or subtraction of such laminations adds to or subtracts from the overall width and height of the core and coil assembly, it is desirable to provide an adjustable clamping and mounting structure which holds the core and coil assembly securely in place relative to the base 50. Therefore, the band 60 which surrounds the core and coil assembly on three sides is formed after the core and coil structure is assembled so as to fit snugly over the core and coil. Flanges 501 of base member 50 are turned up so as to match the width of the band 60 and the core and coil assembly. The top of the band 60 and the base 50 are then compressed together and the legs of the band are welded to the flanges 501 at slots 502.

Base member 50 furthermore serves as a means to mount the transformer assembly 10 to any acceptable surface, whether it be horizontal or vertical. To this end, the base member 50 is provided with portions 504 which extend beyond the core and coil, these portions being provided with holes 506 for receiving screws or bolts for effecting such mounting.

Figure 4:
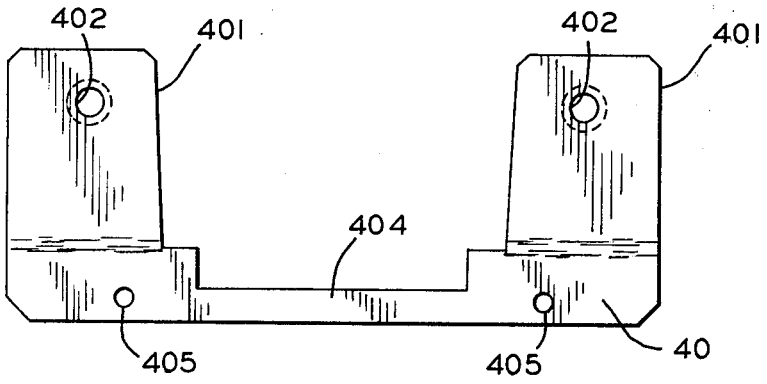
FIG. 4 is a plan view of the terminal board support of the transformer assembly of FIG. 1.

Referring generally now to FIGS. 1 and 4, it can be seen that the terminal board support includes a narrow, elongated section 404 connecting the two tabs 401. It can be appreciated that such may have an adverse effect upon the magnetic circuit of the transformer assembly if left intact. The main purpose of this elongated section 404 is to insure the proper spacing between the holes 405 which serve to hold a terminal board. Therefore, once the transformer clamping-mounting assembly is complete, it is desirable to cut the elongated piece 404 at some point and to provide a separation between the opposite ends of the terminal board support.

It will be appreciated that the manner in which the terminal board support is assembled in the core assembly provides the means to locate a terminal board at any of a number of positions relative to the outside of the core and coil structure. This may be done by placing the space 303 between the laminations, as shown in FIG. 3, at any chosen location; i.e., between any pair of adjacent laminations. Such is accomplished while building and nesting the laminations.

It should be apparent to those skilled in the art that the embodiment described heretofore is considered to be the presently preferred form of the invention. In accordance with the patent statutes, changes may be made in the disclosed device and the manner in which it is used without actually departing from the true spirit and scope of the invention.

What is claimed is:

1. An electrical transformer comprising:

(a) first and second core members disposed side by side, each of said core members being in the form of a plurality of nested laminations wrapped around a central opening;

(b) a terminal board support comprising first and second substantially flat, elongated tabs, said tabs being inserted respectively between adjacent laminations in said first and second core members, a portion of each of said tabs extending beyond each of said core members for attachment to a terminal board;

(c) a base member having a pair of upturn flanges at opposite ends thereof, said core members being disposed side by side on said base member between said flanges;

(d) a generally U-shaped band having a cross member and opposed depending leg member said band tightly fitting over said core members, the ends of the leg members being fixedly secured to said flanges of said base member whereby said band compresses said laminations of said core members to frictionally engage said tabs and to hold said core members in position on said base member.

2. The transformer of claim 1 wherein the base member serves as means for mounting the transformer and includes mounting means comprising portions of the base member extending beyond said core members on each side thereof orthogonally to said flanges.

3. The transformer of claim 1 wherein the laminations are formed from an elongated band such that opposite ends thereof are adjacent one another along one side of the lamination.

4. The transformer of claim 1 wherein the base member is provided with upwardly projecting flanges which engage the sides of said core members for preventing said core members from slipping laterally relative to said U-shaped band and said base member.

5. The transformer of claim 1 wherein the portions of the terminal board support inserted into the cores are provided respectively with a hole with extruded edges for achieving frictional engagement with the core laminations.

* * * * *